US007814944B2

(12) United States Patent
Weglin

(10) Patent No.: US 7,814,944 B2
(45) Date of Patent: Oct. 19, 2010

(54) FORCED AIR VENTILATION SYSTEM FOR FOOTWEAR

(76) Inventor: Ronald G. Weglin, 4027 54th Ave. Southwest, Seattle, WA (US) 98116

( * ) Notice: Subject to any disclaimer, the term of this patent is extended or adjusted under 35 U.S.C. 154(b) by 182 days.

(21) Appl. No.: 12/251,255

(22) Filed: Oct. 14, 2008

(65) Prior Publication Data

US 2009/0038183 A1 Feb. 12, 2009

Related U.S. Application Data

(63) Continuation of application No. 11/181,297, filed on Jul. 14, 2005, now Pat. No. 7,493,926.

(60) Provisional application No. 60/609,772, filed on Sep. 14, 2004.

(51) Int. Cl.
*B65B 1/04* (2006.01)

(52) U.S. Cl. ..... 141/351; 141/63

(58) Field of Classification Search ..... 141/351, 141/37, 48, 63, 66, 113, 301, 313, 360, 362; 36/3 R, 29, 35 B, 37, 3 A, 3 B, 89
See application file for complete search history.

(56) References Cited

U.S. PATENT DOCUMENTS 2,708,320 A 5/1955 Hilton
5,353,605 A * 10/1994 Naaman ..... 62/259.3
5,375,430 A 12/1994 Siegel
5,826,349 A * 10/1998 Goss ..... 36/3 R
5,829,492 A * 11/1998 Gavronsky et al. ..... 141/96
5,918,381 A 7/1999 Landry
6,095,256 A * 8/2000 Lindsay ..... 173/115
6,230,501 B1 5/2001 Bailey, Sr. et al.
6,408,902 B1 * 6/2002 Liau ..... 141/313
6,463,679 B1 10/2002 Buttigieg
6,594,917 B2 7/2003 Ricco'et al.
2002/0069552 A1 6/2002 Ortiz
2003/0047301 A1 3/2003 Ichigaya

OTHER PUBLICATIONS

Seven, R., "Just Cool It," URL=http://seattletimes.nwsource.com/cgi-bin/PrintStory.pl?document_id=2002444553 &zsection_id=2002443447&slug=pacific_pfit28 &date=20050826, download date Aug. 28, 2005.
Nordie, T., "Air-Conditioned Football Pads Developed by UF Scientists Could Help Players Stay Cool," http://www.napa.ufl.edu/2004news/footballpads.htm, download date Sep. 14, 2004.

* cited by examiner

*Primary Examiner*—Gregory L Huson
*Assistant Examiner*—Jason K Niesz
(74) *Attorney, Agent, or Firm*—Seed IP Law Group PLLC

(57) ABSTRACT

A shoe ventilation system for footwear that includes a shoe and a shoe ventilation device. The shoe includes a fitting for connecting to a pressurized air or gas source, such as refrigerated air from a refrigeration source, and the shoe ventilation device includes a fitting to connect to the shoe and a user-actuated valve for controlling the flow of air or gas.

18 Claims, 6 Drawing Sheets

FORCED AIR VENTILATION SYSTEM FOR FOOTWEAR

BACKGROUND OF THE INVENTION

1. Field of the Invention

The present invention generally relates to the ventilation of footwear and, more specifically, to a device for providing on-demand pressurized air to shoes and to a shoe that is configured to be ventilated while worn by a user.

2. Description of the Related Art

During vigorous athletic activity the temperature of an athlete's foot may rise. The increase in foot temperature is uncomfortable, as well as possibly harmful. When foot temperature rises, the foot swells and edema may occur. Further, neuro-muscular responsiveness of the foot decreases, thereby lowering athletic performance and increasing the potential for injury.

Previous methods and devices for cooling shoes include air-conditioning and ventilation systems integrated within the shoe at the time of manufacture. For example, Siegel (U.S. Pat. No. 5,375,430) and Ricco et al. (U.S. Pat. No. 6,594,917), disclose air-conditioning devices integrated within a shoe. While these devices may increase the comfort of a shoe, the integration of the air-conditioning device increases the size, weight, and cost of manufacture of the shoe.

Landry (U.S. Pat. No. 5,918,381), Ortiz (U.S. Patent Application 2002/0069552), and Ichigaya (U.S. Patent Application 2003/0047301) disclose integrated ventilation fans for the ventilation of shoes. Like the integrated air-conditioning devices discussed above, integrated ventilation fans increase the size, weight, and cost of the shoe.

Buttigieg (U.S. Pat. No. 6,463,679) discloses a compressible air chamber integrated into the sole of a shoe. While the air chamber is designed to force air into the interior of the shoe, the placement of the air chamber necessarily affects the elasticity of the sole. Accordingly, the performance of the shoe is affected.

Therefore, it is desirable to have a simple, lightweight system for the cooling of feet that is adaptable to existing shoes and incorporated into new shoes.

BRIEF SUMMARY OF THE INVENTION

The disclosed embodiments of the invention are directed to a shoe ventilation system and to a corresponding shoe. In accordance with one embodiment of the invention, a shoe cooling device is provided that includes a supply port for receiving a supply of pressurized air or gas; an output port for connection to a ventilated shoe; and a pressure-actuated valve for the control of the air or gas supply from the input port to the output port.

In accordance with another embodiment of the invention, a shoe is provided having an input port for receiving pressurized air or gas from an external source, such as the above-mentioned shoe ventilation device, the input port in fluid communication with an interior of the shoe.

In accordance with yet another embodiment of the invention, a shoe ventilation system is provided that includes the shoe cooling device and shoe wherein the input port on the shoe is sized and shaped to couple to the output port of the shoe cooling device and to activate the pressure actuated valve to introduce pressurized gas into the shoe.

In accordance with a further embodiment of the invention, a ventilation device for providing pressurized gas to the footwear of a user while worn by the user is provided, the device including an input for receiving pressurized gas, an output for distributing the pressurized gas received from the input, the output configured to provide the pressurized gas to the footwear, and a user-actuated device for controlling the output of pressurized gas to the footwear.

In accordance with yet a further embodiment of the invention a ventilation device is provided for providing pressurized gas to the shoe of the user while worn by the user, the device including an input for receiving pressurized gas, an output for delivering pressurized gas, and a user-actuated valve for controlling the supply of pressurized gas from the input to the output.

In accordance with another embodiment of the invention, a system for ventilating shoes is provided. The system includes a shoe ventilation device for providing pressurized gas to the shoe of a user while worn by the user, the shoe ventilation device including an input for receiving pressurized gas, an output for delivering pressurized gas, and a user-actuated valve for controlling the supply of pressurized gas from the input to the output, the system further including a shoe having an input for receiving the pressurized gas, the input formed on a portion of the shoe and in fluid communication with an interior of the shoe, the input configured to prevent introduction of water and dirt to the interior of the shoe while selectively admitting the pressurized gas to the interior of the shoe.

BRIEF DESCRIPTION OF THE SEVERAL VIEWS OF THE DRAWINGS

The foregoing and other aspects of the present invention will be better appreciated with reference to the following detailed description of the invention in conjunction with the accompanying drawings, wherein.

DETAILED DESCRIPTION OF THE INVENTION

Figure 1:
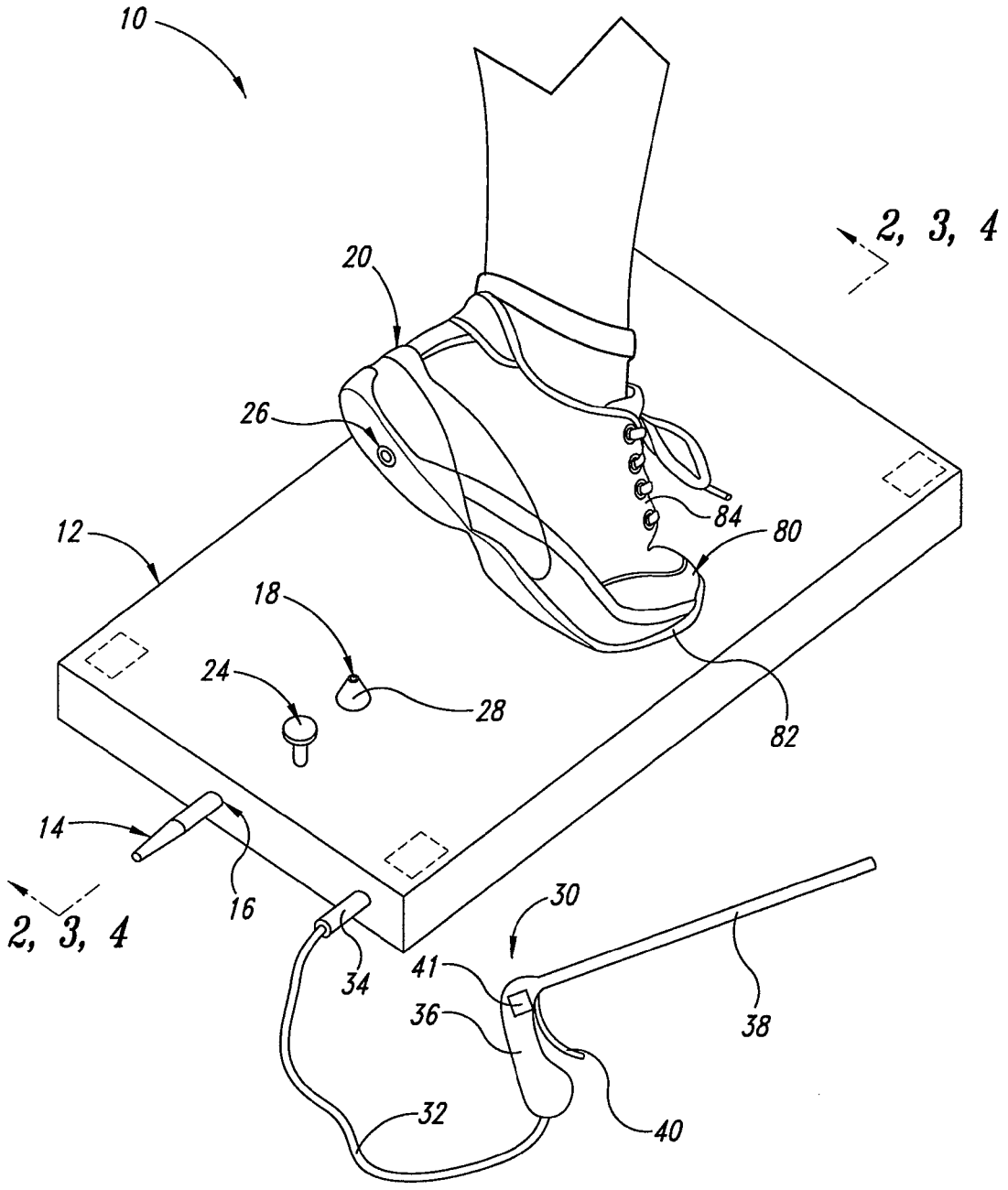
FIG. 1 is an isometric view of a shoe ventilation system formed in accordance with the present invention.

Referring initially to FIG. 1, shown therein is a shoe ventilation system 10 in accordance with one embodiment of the invention that includes a base plate 12 configured to be coupled to a source of pressurized gas (not shown) by an input fitting 14 communicating with an inlet port 16, and further including an outlet port 18. The system 10 further includes footwear, in this embodiment a shoe 20 having an interior 22 (shown in FIG. 3) configured to be in fluid communication with the outlet port 18. The source of pressurized gas can be a remotely-located supply terminal or a portable tank that can be built in, attached to, or associated with the base plate 12.

A valve 24 is positioned adjacent to and in fluid communication with the outlet port 18 and configured to be activated by pressure of the shoe 20. In this embodiment, the shoe 20 includes an inlet port 26 configured to provide fluid communication, and in particular a gas, vapor, or air, between the exterior of the shoe 20 and the interior 22 thereof. The inlet port 26 is configured to be slideably received over a cone-shaped nozzle 28 formed over the outlet port 18 to direct air into the shoe 20. Although the nozzle 28 is shown as having a cone shape, it is to be understood that other shapes may be used.

Also shown in FIG. 1 is an optional hand wand 30 coupled to the base plate 12 via an air hose 32 and fitting 34 to be in fluid communication with the inlet port 16, which is described in more detail herein below. The wand includes a handle 36 coupled at one end to the air hose 32 and having extending from the other end a tubular nozzle 38 that is preferably rigid for insertion into the shoe 20 to provide localized user-directed pressurized gas. The shape of the nozzle 38 can be matched to the shape of the inlet port 26 or it can be configured to disburse the pressurized gas into other areas of the shoe. Thus, the nozzle 38 can be round, cone-shaped, flat, or have another shape, and can be adjustable for volume or it can include a diffuser attachment. A trigger 40 formed on the handle 36 activates the hand wand 30. The trigger can be a simple on-off switch or a proportional valve to control volume or pressure or both or an electro-mechanically actuated valve 41. In use, the hand wand nozzle 38 can be inserted between the user's foot and a sidewall of the shoe, at the heel of the shoe, or on the top forward portion of the shoe near the toe as well as at any other location selected by the user where gas or air can be introduced into the interior 22 of the shoe.

Figure 2:
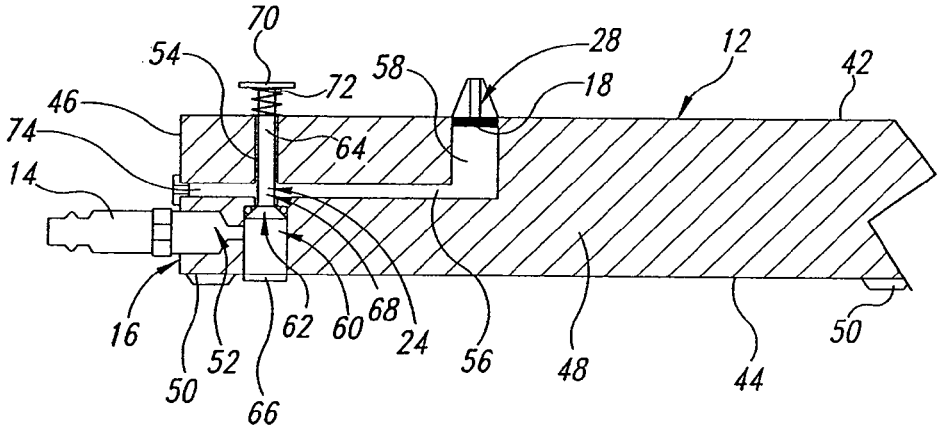
FIG. 2 is a partial cross-sectional view of a base plate formed in accordance with the present invention.

Referring next to FIG. 2, shown therein is a partial cross-sectional view of the base plate 12 having a top surface 42, bottom surface 44, and sidewall 46. Ideally, the base plate 12 is formed of solid, rigid material 48, preferably acrylic, although lightweight metal, such as aluminum may also be used. However, it is to be understood that any solid, rigid material, including wood, metal, or other plastics will suffice. Acrylic is generally more economical and easier to machine, as well as being wear resistant, and hence this material or one possessing similar properties is preferred. On the bottom wall 44 of the base plate 12 are skid pads 50, such as self-adhesive non-skid pads, to prevent the base plate 12 from slipping on a supporting surface (not shown).

The input fitting 14 is in fluid communication with the inlet port 16 that is formed from a first horizontal passageway 52 that intersects with a first vertical passageway 54 extending through the base plate 12 to provide fluid communication from the bottom wall 44 to the top wall 42. A second horizontal passageway 56 is formed above the first horizontal passageway 52 and opens to the sidewall 46 and terminates at a second vertical passageway 58 that terminates in the outlet port 18 in the top wall 42 of the base plate 12. The cone-shaped nozzle 28 is preferably threadably engaged with the outlet port 18. However, it is to be understood that other means of securing the nozzle 28 to the outlet port 18 may be used, as will be readily known to those of ordinary skill in this technology.

The first vertical passageway 54 has an enlarged section 60 sized and shaped to receive the body 62 of the air valve 24. The enlarged section 60 of the first vertical passageway 54 is closed off at the bottom surface 44 of the base plate 12 with a plug 66. A stem 64 extends upward from the valve body 62 and extends out of the base plate 12 above the top surface 42. Ideally, the stem 64 is biased to have the valve body 62 seat against a matching upper wall 68 of the enlarged portion 60 of the first vertical passageway 54. A biasing member, such as a spring 72, is positioned between the top surface 42 of the base plate 12 and a horizontal plate 70 on the stem 64 to urge the valve 24 into the closed position. A plug 74 closes off the second vertical passageway 56 at the sidewall 46.

In operation, pressurized fluid, such as a gas, vapor, or air, is provided at the inlet port 16 through the input fitting 14 and into the enlarged portion 60 of the first vertical passageway 54. The valve 24 is biased in the closed position by the spring 72 until pressure from the heel of the shoe 22 on the horizontal plate 70 forces the valve body 62 downward past the first horizontal passageway 52.

Figure 3:
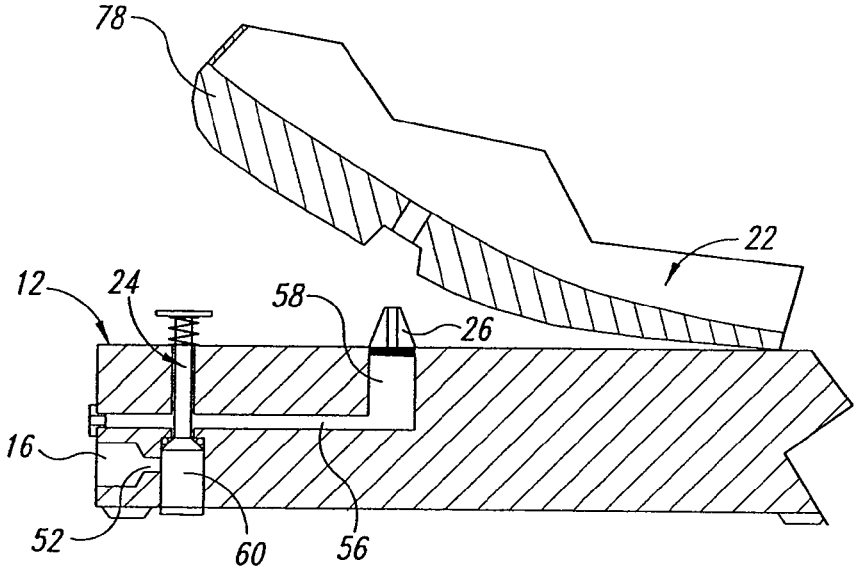
FIG. 3 is a schematic view of the pneumatic system of the present invention in first operational configuration.
Figure 4:
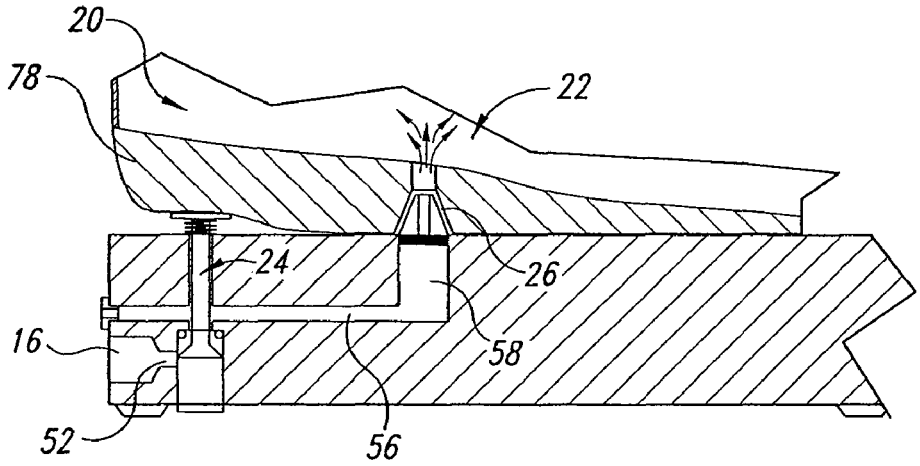
FIG. 4 is a schematic view of the pneumatic system of the present invention in a second operational configuration.

Reference is now made to two operational diagrams shown in FIGS. 3 and 4, wherein FIG. 3 shows the valve 24 in the closed position and FIG. 4 shows the valve 24 in the open position to admit pressurized air into the second horizontal passageway 56 and the intersecting second vertical passageway 58, through the nozzle 28 and into the interior 22 of the shoe 20.

In the embodiment shown in FIGS. 3 and 4, the heel 78 includes the inlet valve 26 formed therein. It is to be understood, however, that an inlet valve may be formed near the toe of the shoe or at other locations on the bottom surface, top surface, side walls, and front and rear sides of the shoe 20 as desired. The inlet valve can be configured to be a one-way valve, such as is used on basketballs and the like, admitting air into the interior 22 of the shoe 20 and closing off to prevent air or gas from escaping. In addition, the inlet valve 26 can be formed to prevent elements from the exterior of the shoe 20, such as water or hot air, from being admitted into the interior 22 of the shoe 20.

Figure 5A:
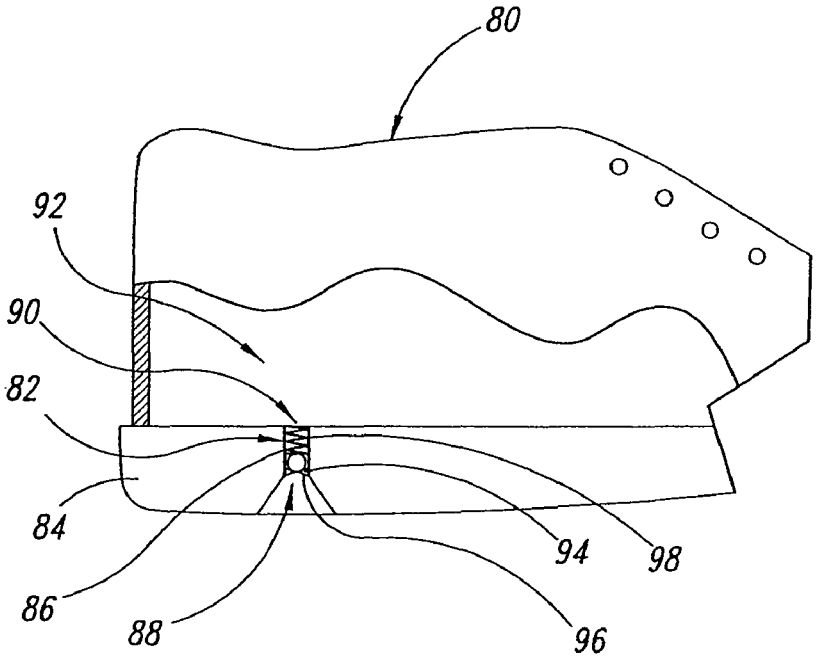
FIGS. 5A-5C are cross-sectional views of an inlet valve in the heel of a shoe in accordance with another embodiment of the invention.
Figures 5B, 5C:
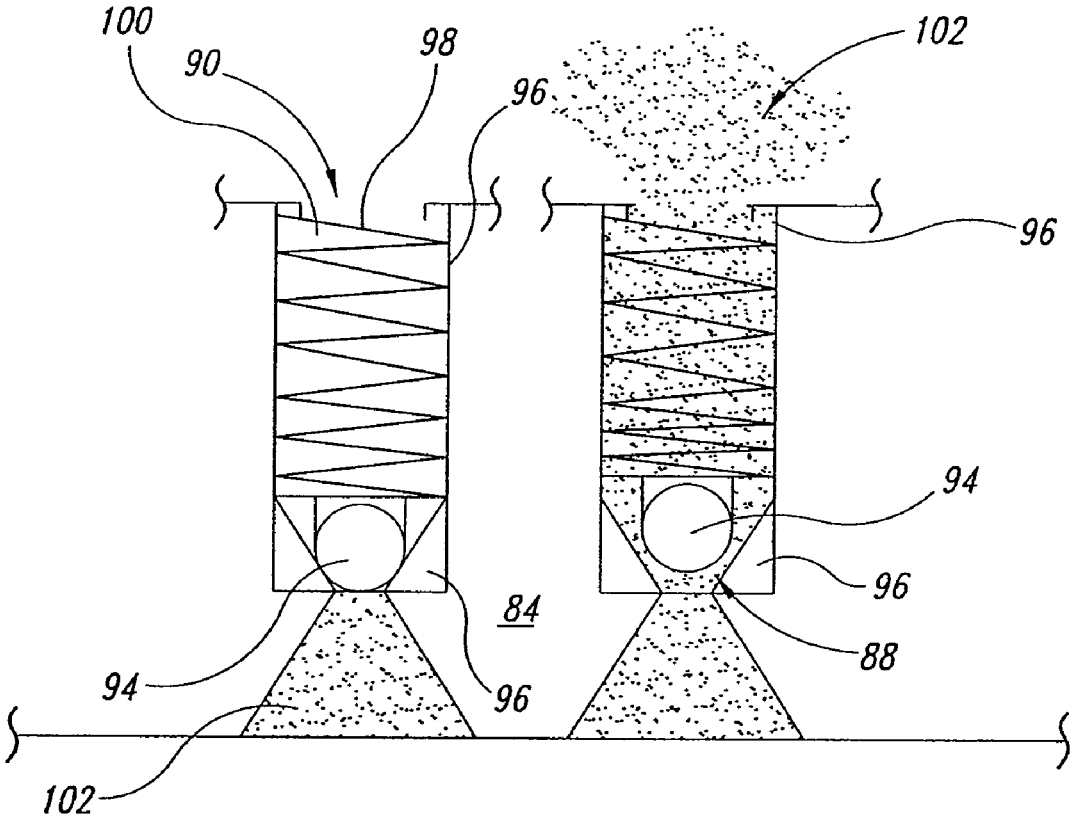

FIGS. 5A-5C show another embodiment of the invention wherein a shoe 80 is shown having a valve 82 installed in the heel 84. The valve 82 has a valve body 86 with a first opening 88 communicating with a second opening 90 that opens to the shoe's interior 92. A ball 94 seals in a seat 96 at the second opening 90 and is held in place by a spring 98 mounted between the ball 94 and a retaining member 100, as shown more clearly in FIG. 5B. When pressurized gas 102 is introduced at the first opening 88 with sufficient force to overcome the spring 98, the ball 94 is urged off the seat 96 to admit the gas 102 into the interior 92 of the shoe 80.

So long as pressure from the heel 78 of the shoe 20 continues to push the valve 24 into the open position, pressurized air will continue to be injected into the interior 22 of the shoe 20. It is to be understood that gases other than ordinary air may be used, such as a mixture of air and anti-fungal agent, scented air, or a combination of the foregoing or coolants and the like.

Although a preferred embodiment of the invention has been illustrated and described, it is to be understood that various changes may be made therein without departing from the spirit and scope of the invention. For example, a shell-shaped front air delivery system 100 shown in FIGS. 6A-6B can be used alone or in combination with the heel valve 26 to provide air to the toe of the shoe or to additional areas of the shoe 20. A user would slip the toe 80 of the shoe into a shell-shaped receiver 102 that is in fluid communication with the source of pressurized air, such as with the inlet port 16, and is activated by a valve similar to the inlet valve 24 or by a sensor, such as infrared or other proximity or presence sensor 104. Air can be introduced through the sole 82 of the shoe in a manner similar to the inlet valve 26 in the heel 78 or toe 80 of the shoe 20. Air or gas can also be introduced through the top 84 of the shoe, which is generally ventilated and does not require modification of the shoe, or a combination of both.

Figure 6A:
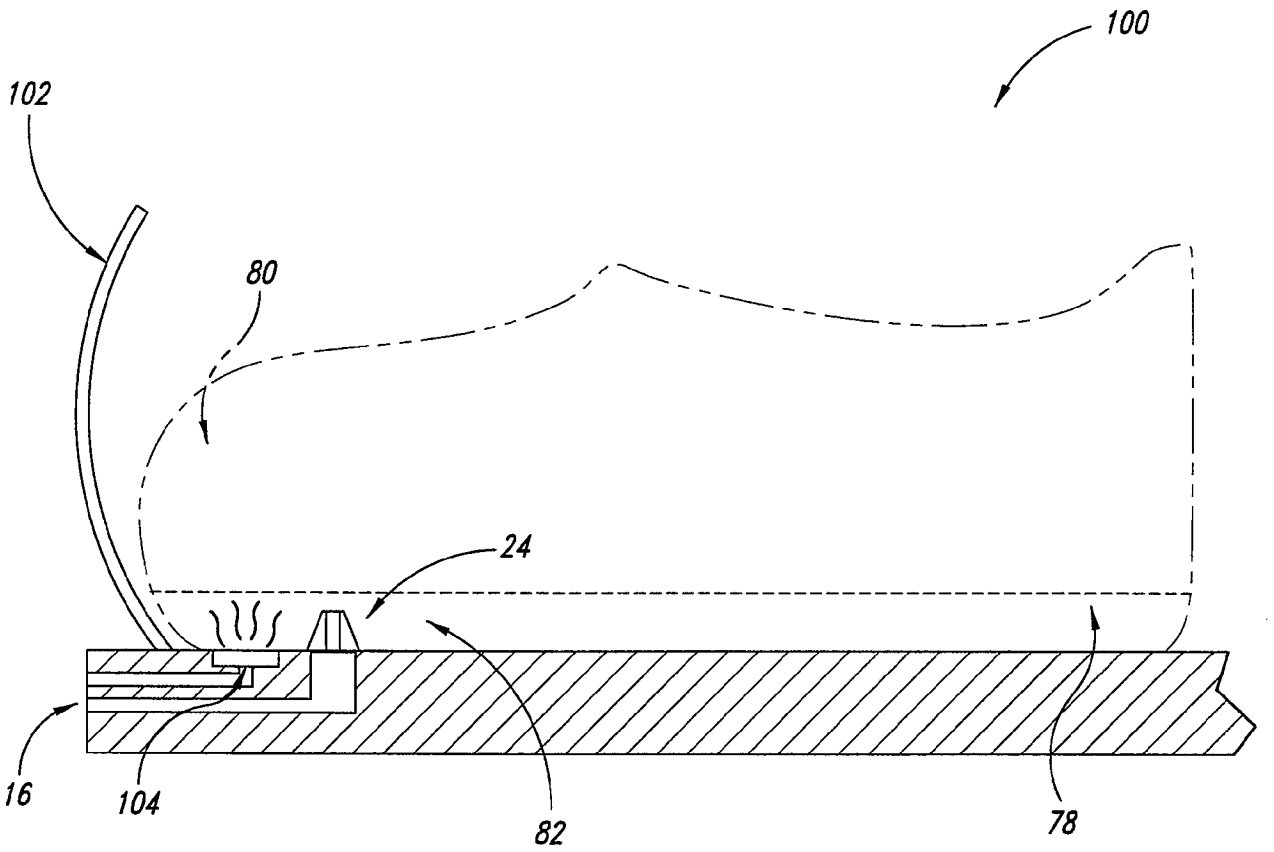
FIGS. 6A-6B are a cross-sectional side view and a top view, respectively, of an alternative embodiment.
Figure 6B:
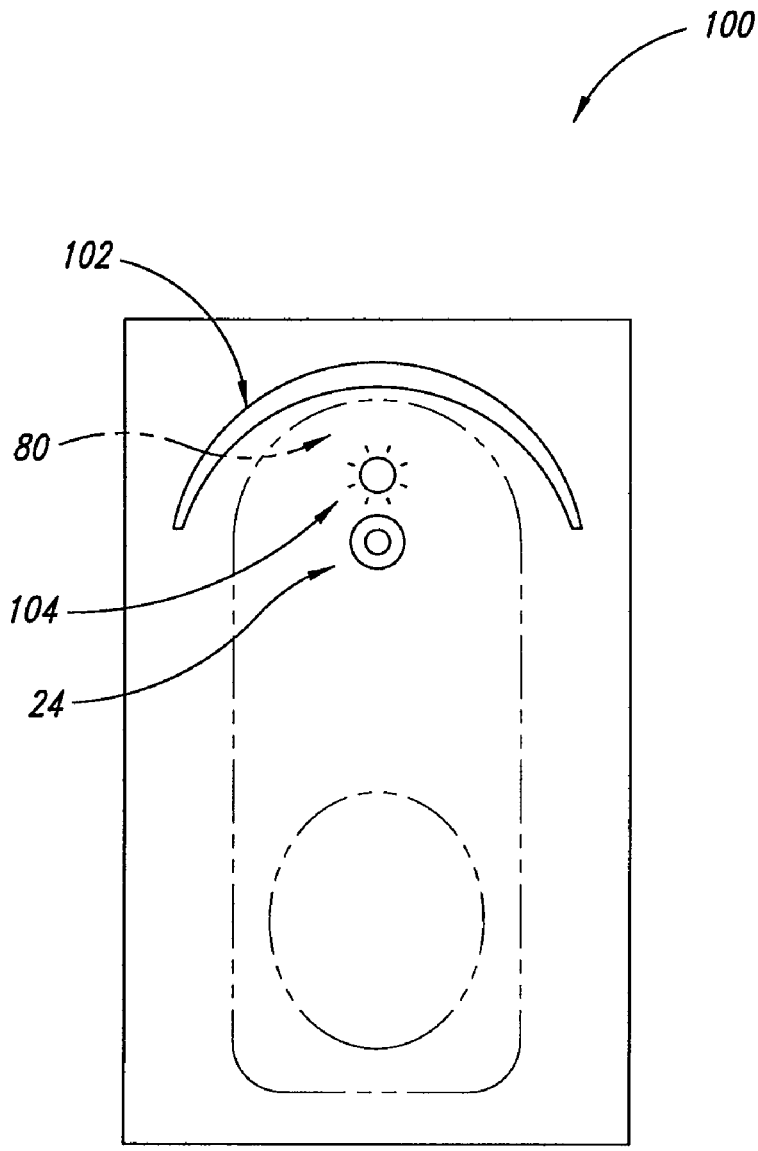

With respect to the shoe 20, existing shoes can be easily modified to accommodate the inlet valve 26. If such a valve were in the toe 80 of the shoe 20, activation of the inlet valve 24 would be accomplished by simply reversing the position of the shoe shown in FIGS. 3 and 4 so that the sole 82 at the toe 80 of the shoe 20 presses down on the inlet valve 24 as shown in FIG. 6A.

In another embodiment the valve 24 can be activated by either the foot pressure or a hand-actuated control or a combination of both. Optionally, the hand wand can be configured to control the foot valve alone, the hand wand alone without the presence of a foot valve in the base, or a combination of the hand wand and the foot valve.

As will be readily appreciated from the foregoing, those engaged in sports, such as baseball, basketball, football, and soccer, as well as other sports, and recreational users, such as walkers, and those who must stand and/or walk or run for substantial periods of time will find relief from fatigue and resistance to injury in the foot and ankle area for use of the present invention. As foot temperature rises, swelling of the foot can cause edema. Neurological responses in the foot are reduced, creating the potential for injury due to sluggish brain-to-foot communication. The cooler foot temperatures provided by the present invention will energize the foot, and the introduction of aromatherapy will enhance this effect.

It is anticipated that the present invention could be used on the sidelines or bench, allowing athletes to restore their foot temperature to pre-game conditions. In addition, where individuals or groups of people are walking or exercising, such as at shopping malls, theme parks, fairs, health clubs, home shows, airports, and the like, portable stations can be set up for use, which can be coin activated.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A ventilation device for providing pressurized gas to the footwear of a user while worn by the user, the device comprising:

a base to accommodate the footwear of the user while worn by the user;

an input mounted on the base for receiving pressurized gas;

an output mounted on the base for distributing the pressurized gas received from the input, the output configured to provide the pressurized gas to the footwear; and a valve mounted on the base and adapted to be actuated by the footwear of the user while worn by the user, the valve aligned with the output and in fluid communication with the input and output for controlling the output of pressurized gas to the footwear.

2. The device of claim 1, further comprising a source of pressurized gas in fluid communication with the input.

3. The device of claim 2, wherein the source of pressurized gas comprises a device for storing pressurized gas.

4. The device of claim 3, wherein the pressurized gas is non-refrigerated.

5. The device of claim 1, wherein the output comprises a fitting fixedly mounted on the base for coupling to the footwear and delivering pressurized gas through the output to the interior of the footwear.

6. The device of claim 1, further comprising a hand-held delivery device coupled to the output via a flexible conduit for delivering pressurized gas through a nozzle mounted on the flexible conduit.

7. A ventilation device for providing pressurized gas to the shoe of a user while worn by the user, the device comprising:

a base to accommodate the shoe of the user while worn by the user;

an input mounted on the base for receiving pressurized gas;

an output mounted on the base for delivering pressurized gas; and a foot-actuated fluid control valve mounted on the base for controlling the supply of pressurized gas from the input to the output.

8. The device of claim 7, wherein the output comprises a fitting mounted on the base and the foot-actuated valve is mounted on the base and in fluid communication with the fitting.

9. The device of claim 7, further comprising a hand-held delivery device coupled via a flexible conduit to the output on the base.

10. The device of claim 9, wherein the hand-held delivery device comprises a hand-actuated valve mounted in the hand-held delivery device.

11. The device of claim 10, wherein the hand-actuated valve comprises an electro-mechanical valve controlled by a switch mounted in the hand-held delivery device.

12. The device of claim 9, further comprising an electro-mechanical valve mounted on the base and coupled to the hand-held delivery device via the flexible conduit, the electro-mechanical valve controlled by pressure from the user's foot.

13. The device of claim 7, wherein the output comprises a housing configured to receive the toe of a shoe, and the valve is mounted in the housing for controlling the supply of the pressurized gas to the shoe.

14. The device of claim 7, wherein the output comprises a fitting mounted on a base and configured to deliver the pressurized gas to the shoe, and the output further comprises a hand-held delivery device coupled to the base via a flexible conduit for delivering pressurized gas through the hand-held delivery device.

15. The device of claim 14, wherein the hand-held delivery device comprises a valve mounted therein that is actuated by a hand-actuated device in the hand-held delivery device.

16. The device of claim 15, wherein the valve mounted in the base is actuated by an electro-mechanical device that is controlled by a switch mounted in the hand-held delivery device.

17. The device of claim 7, wherein the output comprises a housing for receiving the toe of a shoe and the valve is mounted in the housing for supplying air through the toe of the shoe.

18. The device of claim 17, wherein the valve is actuated by a sensor in the housing that detects the presence of the shoe.

* * * * *